US008894776B2

(12) United States Patent
Gnadinger et al.

(10) Patent No.: US 8,894,776 B2
(45) Date of Patent: Nov. 25, 2014

(54) NON-ELECTRONIC METHODS AND APPARATUS FOR DETECTING WASH PUMP CAVITATION IN A DISHWASHER

(75) Inventors: Errin Whitney Gnadinger, Louisville, KY (US); Brian Worrasangasilpa, Louisville, KY (US)

(73) Assignee: General Electric Company, Schenectady, NY (US)

( * ) Notice: Subject to any disclaimer, the term of this patent is extended or adjusted under 35 U.S.C. 154(b) by 584 days.

(21) Appl. No.: 13/157,457

(22) Filed: Jun. 10, 2011

(65) Prior Publication Data

US 2012/0312325 A1 Dec. 13, 2012

(51) Int. Cl.

| | |
|---|---|
| ***A47L 15/42*** | (2006.01) |
| ***A47L 15/46*** | (2006.01) |
| ***A47L 15/00*** | (2006.01) |

(52) U.S. Cl.

CPC ..... *A47L 15/0049* (2013.01); *A47L 15/4225* (2013.01); *A47L 15/46* (2013.01); *A47L 2501/05* (2013.01); *A47L 2401/14* (2013.01); *A47L 15/4244* (2013.01); *A47L 2501/01* (2013.01); *A47L 2401/08* (2013.01)

USPC ..... 134/56 D; 134/57 D; 134/58 D

(58) Field of Classification Search

None

See application file for complete search history.

(56) References Cited

U.S. PATENT DOCUMENTS

| | | | | |
|---|---|---|---|---|
| 5,313,964 | A * | 5/1994 | Dausch et al. | 134/57 D |
| 5,402,809 | A * | 4/1995 | Smith | 134/129 |
| 5,487,528 | A | 1/1996 | Richmond | |
| 5,878,603 | A | 3/1999 | Warren, Jr. et al. | |
| 7,621,283 | B2 * | 11/2009 | Zentner et al. | 134/57 D |

* cited by examiner

*Primary Examiner* — Joseph L Perrin

*Assistant Examiner* — Levon J Shahinian

(74) *Attorney, Agent, or Firm* — Global Patent Operation; Douglas D. Zhang

(57) ABSTRACT

Water fill level detection techniques are provided for a dishwasher system. A dishwasher system includes a tub; a fluid circulation system for circulating water in the tub and a cavitation sense fill system. The fluid circulation system includes at least one recirculation pump and at least one fill valve. The cavitation sense fill system monitors an output pressure of the at least one recirculation pump. The cavitation sense fill system deactivates the at least one fill valve when the output pressure satisfies at least one predefined criteria. A pressure wave damper may optionally be employed to ensure stable pressure measurements.

8 Claims, 6 Drawing Sheets

NON-ELECTRONIC METHODS AND APPARATUS FOR DETECTING WASH PUMP CAVITATION IN A DISHWASHER

BACKGROUND OF THE INVENTION

The present disclosure relates generally to dishwashers and, more particularly, to techniques for detecting a water fill level in dishwashers. A dishwasher is a mechanical device for cleaning dishes, utensils and other items. Various types of dishwashers are known and are currently available. Spray dishwashers, for example, spray warm water and detergent within a dishwasher cabinet to wash the items arranged in racks. Typically, the spray dishwasher employs one or more rotating spray arms that spray water through holes formed in the arms, a wash reservoir or "sump" where water is collected and a pump to pump the water from the sump to the spray arms.

A number of techniques have been proposed or suggested for reducing energy and water consumption in dishwashers. Existing water conservation techniques, for example, allow dishwashers to use less water while maintaining water velocity and pressure. One aspect of the known water conservation techniques attempt to only fill the dishwashers to an appropriate water fill amount.

Thus, a number of techniques exist for detecting a water fill level in dishwashers. For example, known techniques use timers or water level sensors to control the water fill level. Generally, when the pump motor stops cavitating, there is an appropriate water fill amount in the dishwasher. One technique for monitoring the cavitation utilizes gradients of the current drawn by the pump motor to detect that the water pump has stopped cavitating. While this technique effectively detects an adequate water fill level, it requires a costly increase in the fine balance of the pump motor rotor so that software algorithms can identify current fluctuations due to cavitation. Otherwise, current fluctuations generated from an unbalanced rotor will cause an error in cavitation detection.

A need therefore exists for improved techniques for detecting a water fill level in dishwashers. A further need exists for non-electronic methods and apparatus for controlling a water fill level in dishwashers.

BRIEF DESCRIPTION OF THE INVENTION

As described herein, the exemplary embodiments of the present invention overcome one or more disadvantages known in the art. Generally, water fill level detection techniques are provided for a dishwasher system.

According to one aspect of the invention, a dishwasher system is provided that comprises a tub; a fluid circulation system for circulating water in the tub; and a cavitation sense fill system. The fluid circulation system comprises at least one recirculation pump and at least one fill valve. The cavitation sense fill system monitors an output pressure of the at least one recirculation pump. The cavitation sense fill system deactivates the at least one fill valve when the output pressure satisfies at least one predefined criteria.

According to another aspect of the invention, a cavitation sense fill system for a dishwasher system is provided. In one exemplary embodiment, the cavitation sense fill system comprises a pressure switch for monitoring an output pressure of at least one recirculation pump in the dishwasher system, wherein the pressure switch deactivates at least one fill valve in the dishwasher system when the output pressure satisfies at least one predefined criteria.

Another aspect of the invention provides a method for operating a dishwasher system by monitoring an output pressure of at least one recirculation pump in the dishwasher system; and deactivating at least one fill valve in the dishwasher system when the output pressure satisfies at least one predefined criteria.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

The present invention provides improved techniques for detecting a water fill level in dishwashers. According to one aspect of the invention, an appropriate water fill level is detected by monitoring the output pressure of the recirculation pump.

Figure 1:
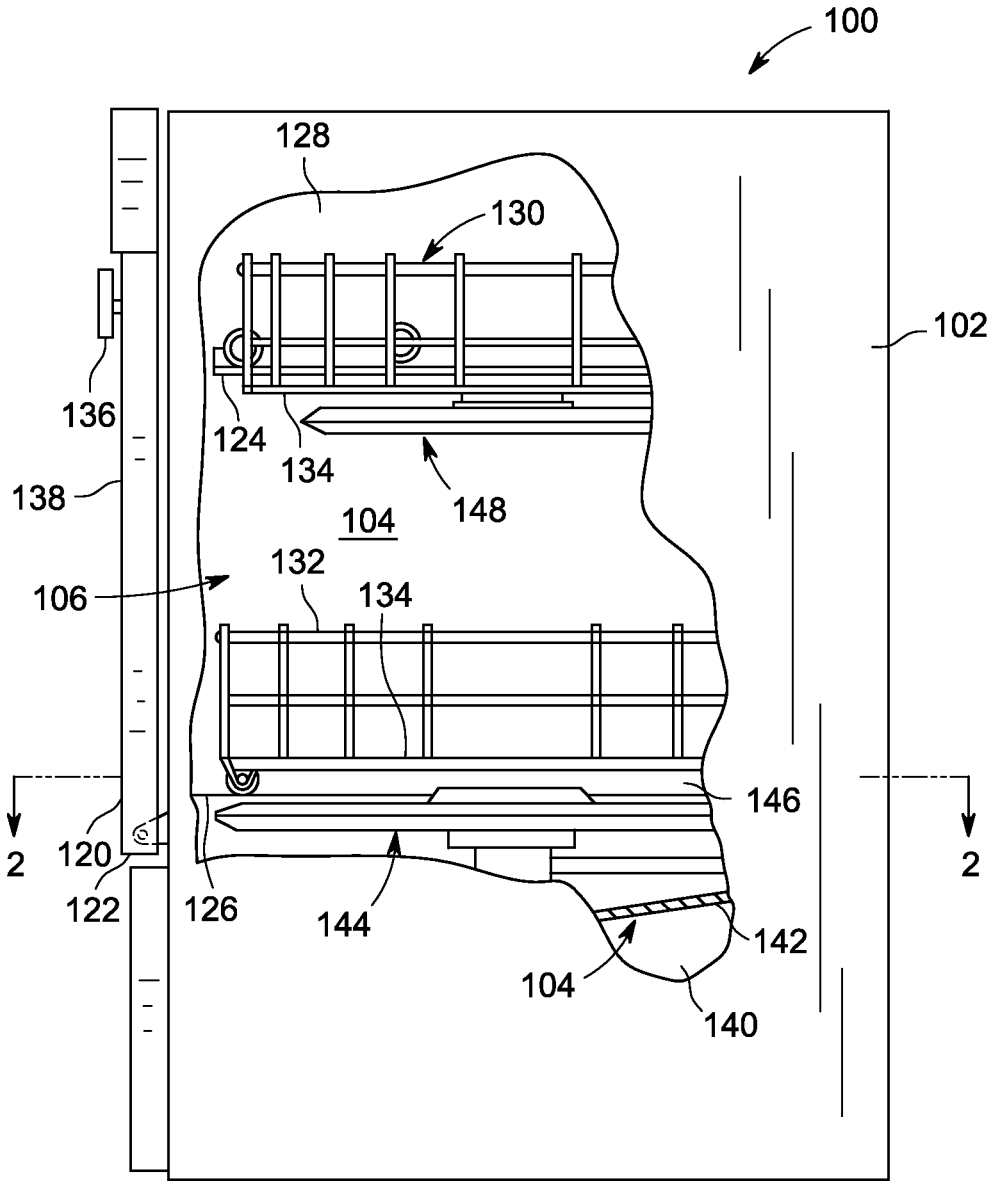
FIG. 1 is a side elevation view of an exemplary domestic dishwasher system partially broken away, and in which the present invention may be implemented.

FIG. 1 is a side elevation view of an exemplary domestic dishwasher system 100 partially broken away, and in which the present invention may be implemented. It is contemplated, however, that the invention may be practiced in other types of dishwashers and dishwasher systems other than just dishwasher system 100 described and illustrated herein. Accordingly, the following description is for illustrative purposes only, and the invention is not limited to use in a particular type of dishwasher system, such as dishwasher system 100.

Dishwasher 100 includes a cabinet 102 having a tub 104 therein and forming a wash chamber 106. Tub 104 includes a front opening (not shown in FIG. 1) and a door 120 hinged at its bottom 122 for movement between a normally closed vertical position (shown in FIG. 1) wherein the wash chamber 106 is sealed shut for washing operation, and a horizontal open position (not shown) for loading and unloading of dishwasher contents.

Upper and lower guide rails 124, 126 are mounted on tub side walls 128 and accommodate upper and lower roller-equipped racks 130, 132, respectively. Each of upper and lower racks 130, 132 is fabricated from known materials into lattice structures including a plurality of elongate members 134, and each rack 130, 132 is adapted for movement between an extended loading position (not shown) in which at least a portion of the rack is positioned outside wash chamber 106, and a retracted position (shown in FIG. 1) in which the rack is located inside wash chamber 106. Conventionally, a silverware basket (not shown) is removably attached to lower rack 132 for placement of silverware, utensils, and the like that are too small to be accommodated by upper and lower racks 130, 132.

A control input selector 136 is provided, for example, at a convenient location on an outer face 138 of door 120 and is coupled to known control circuitry (not shown) and control mechanisms (not shown) for operating a fluid circulation assembly (not shown in FIG. 1) for circulating water and dishwasher fluid in dishwasher tub 104. The fluid circulation assembly is located in a machinery compartment 140 located below a bottom sump portion 142 of tub 104, and its construction and operation is explained in detail below.

A lower spray-arm-assembly 144 is rotatably mounted within a lower region 146 of wash chamber 106 and above tub sump portion 142 so as to rotate in relatively close proximity to lower rack 132. A mid-level spray-arm assembly 148 is located in an upper region of wash chamber 106 in close proximity to upper rack 130 and at a sufficient height above lower rack 132 to accommodate items such as a dish or platter (not shown) that is expected to be placed in lower rack 132. In a further embodiment, an upper spray arm assembly (not shown) is located above upper rack 130 at a sufficient height to accommodate a tallest item expected to be placed in upper rack 130, such as a glass (not shown) of a selected height.

Lower and mid-level spray-arm assemblies 144, 148 and the upper spray arm assembly are fed by the fluid circulation assembly, and each spray-arm assembly includes an arrangement of discharge ports or orifices for directing washing liquid onto dishes located in upper and lower racks 130, 132, respectively. The arrangement of the discharge ports in at least lower spray-arm assembly 144 results in a rotational force as washing fluid flows through the discharge ports. The resultant rotation of lower spray-arm assembly 144 provides coverage of dishes and other dishwasher contents with a washing spray. In various alternative embodiments, mid-level spray arm 148 and/or the upper spray arm are also rotatably mounted and configured to generate a swirling spray pattern above and below upper rack 130 when the fluid circulation assembly is activated.

Figure 2:
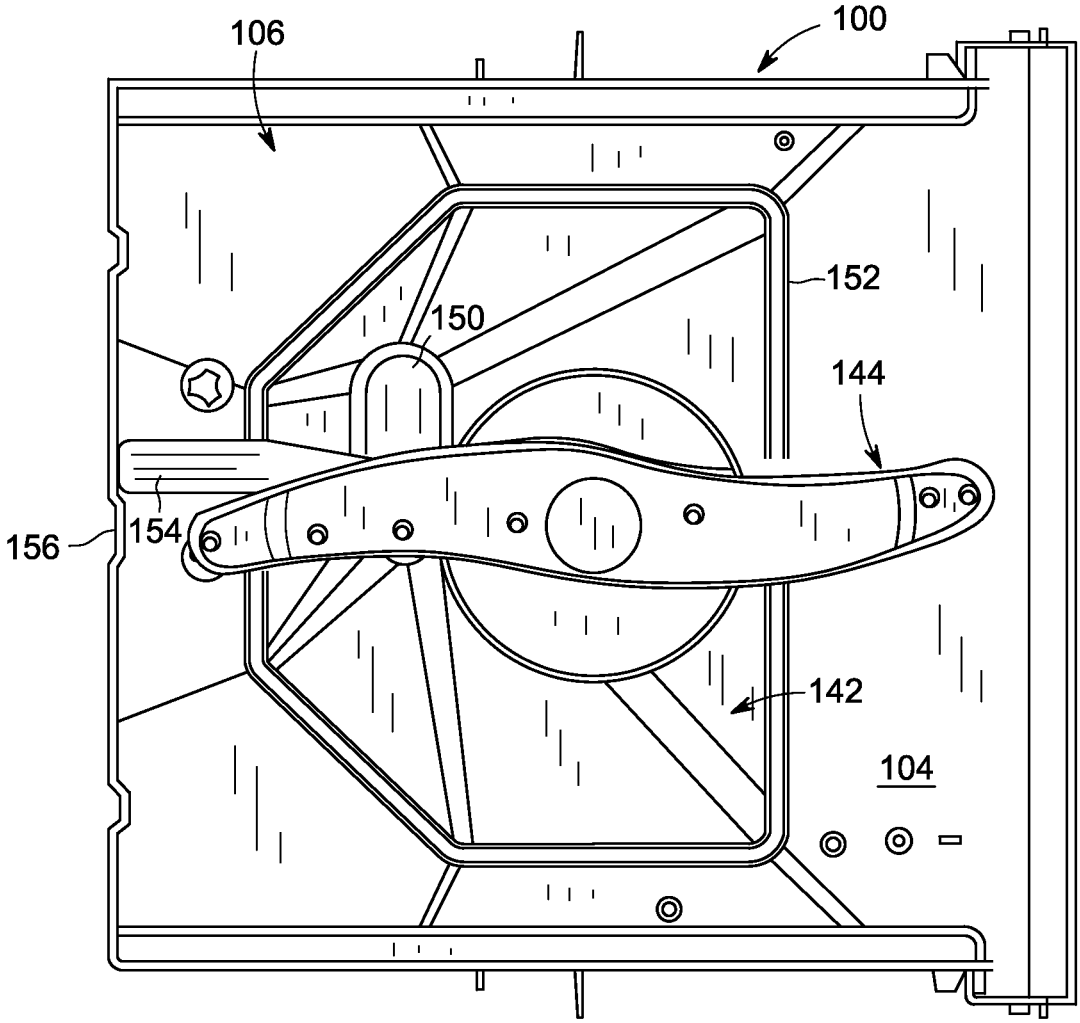
FIG. 2 is a top plan view of the dishwasher system of FIG. 1 along line 2-2.

FIG. 2 is a top plan view of the dishwasher system 100 just above lower spray arm assembly 144. Tub 104 is generally downwardly sloped beneath lower spray arm assembly 144 toward tub sump portion 142, and tub sump portion 142 is generally downwardly sloped toward a sump 150 in flow communication with the fluid circulation assembly (not shown in FIG. 2). Tub sump portion 142 includes a six-sided outer perimeter 152. Lower spray arm assembly is substantially centered within tub 104 and wash chamber 106, off-centered with respect to tub sump portion 142, and positioned above tub 104 and tub sump portion 142 to facilitate free rotation of spray arm 144.

Tub 104 and tub sump portion 142 are downwardly sloped toward sump 150 so that water sprayed from lower spray arm assembly 144, mid-level spray arm assembly 148 (shown in FIG. 1) and the upper spray arm assembly (not shown) is collected in tub sump portion 142 and directed toward sump 150 for filtering and recirculation, as explained below, during a dishwasher system wash cycle. In addition, a conduit 154 extends beneath lower spray arm assembly 144 and is in flow communication with the fluid circulation assembly. Conduit 154 extends to a back wall 156 of wash chamber 106, and upward along back wall 156 for feeding wash fluid to mid-level spray arm assembly 148 and the upper spray arm assembly.

Figure 3:
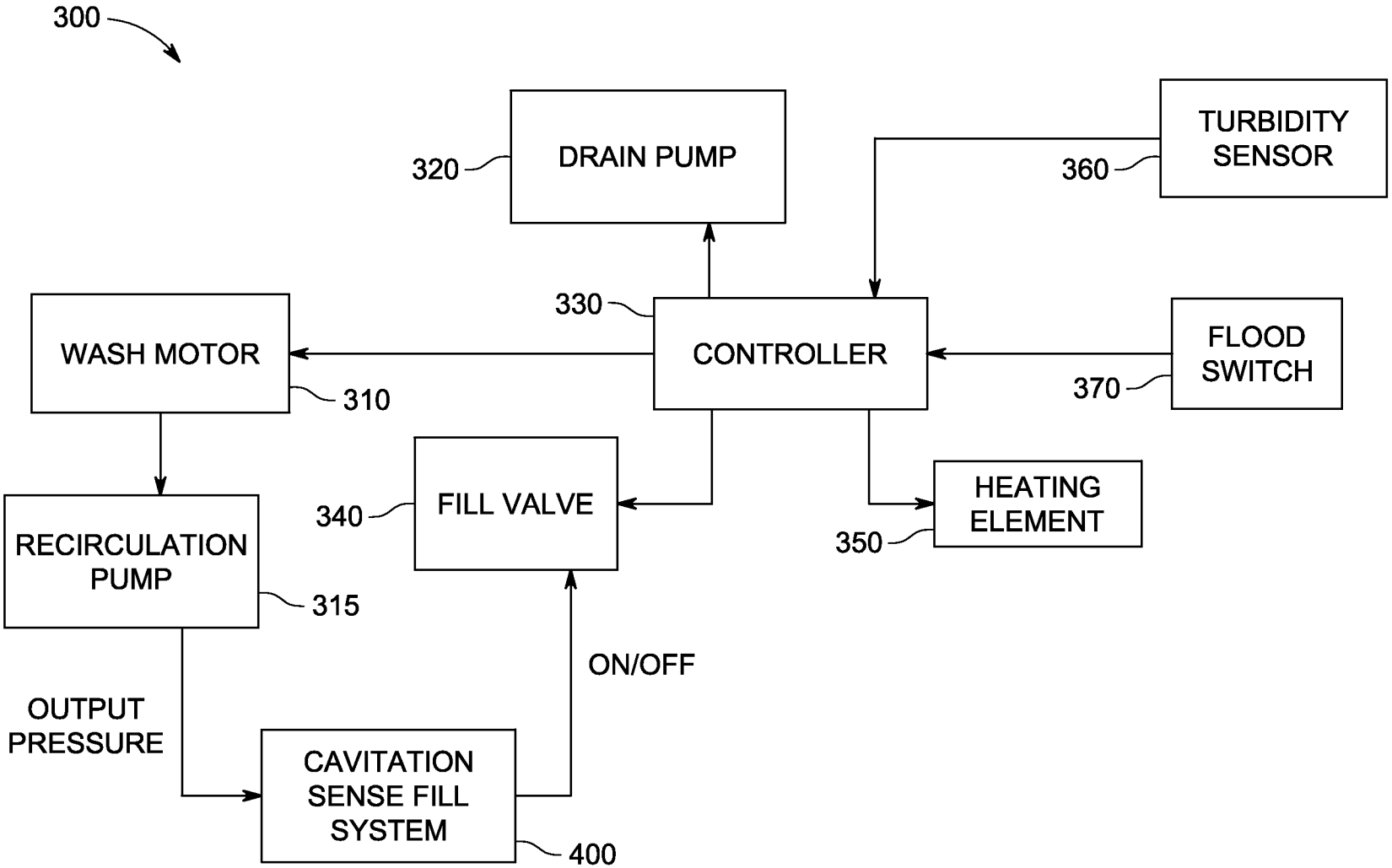
FIG. 3 is a schematic block diagram of an exemplary control system for the dishwasher system of FIG. 1.

FIG. 3 is a schematic block diagram of an exemplary control system 300 for the dishwasher system 100 of FIG. 1. As shown in FIG. 3, the exemplary control system 300 comprises a wash motor 310, a drain pump 320, a controller 330, a fill valve 340, a heating element 350, a turbidity sensor 360 and a flood switch 370, in a known manner. The wash motor 310 runs a recirculation pump 315 that recirculates the water and dishwasher fluid in dishwasher tub 104.

As discussed further below in conjunction with FIG. 4, the exemplary control system 300 includes a cavitation sense fill system 400 that monitors the output pressure of the recirculation pump 315 to determine when an appropriate water fill level has been reached. The cavitation sense fill system 400 may be embodied, for example, as an electro-mechanical pressure switch or an electronic pressure sensor. For example, the electro-mechanical pressure switch may be implemented using commercially available products from MAMCO Precision Switches of Oneonta, N.Y. or Micro Pneumatic Logic, Inc., of Pompano Beach, Fla. An electronic pressure sensor may be implemented, for example, using commercially available products from Bitron industrie S.p.A. of Torino, Italy or Honeywell Sensing and Control of Golden Valley, Minn.

The drain pump 320 comprises a small pump that drains water from the dishwasher system 100. The exemplary controller 330 energizes the fill valve 340 to add water to the dishwasher system 100. As previously noted, adequate water needs to be added to the dishwasher system 100 for proper wash performance. As discussed further below in conjunction with FIGS. 4 and 5, the exemplary cavitation sense fill system 400 detects the water fill level in accordance with the present invention.

In one exemplary embodiment, the fill valve 340 is a solenoid valve that turns the water supply on and off. The heating element 350 can be implemented, for example, using a tubular resistive heating element, such as commercially available Calrod™, heating elements for dishwasher heater applications, to heat the water in the dishwasher system 100 and thereby increase the cleaning performance. The exemplary turbidity sensor 360 senses the cleanliness of the water, in a known manner. Finally, the flood switch 370 comprises a flood protection float switch that interrupts power to the fill valve to prevent flooding of the home in the event of a failure.

Figure 4:
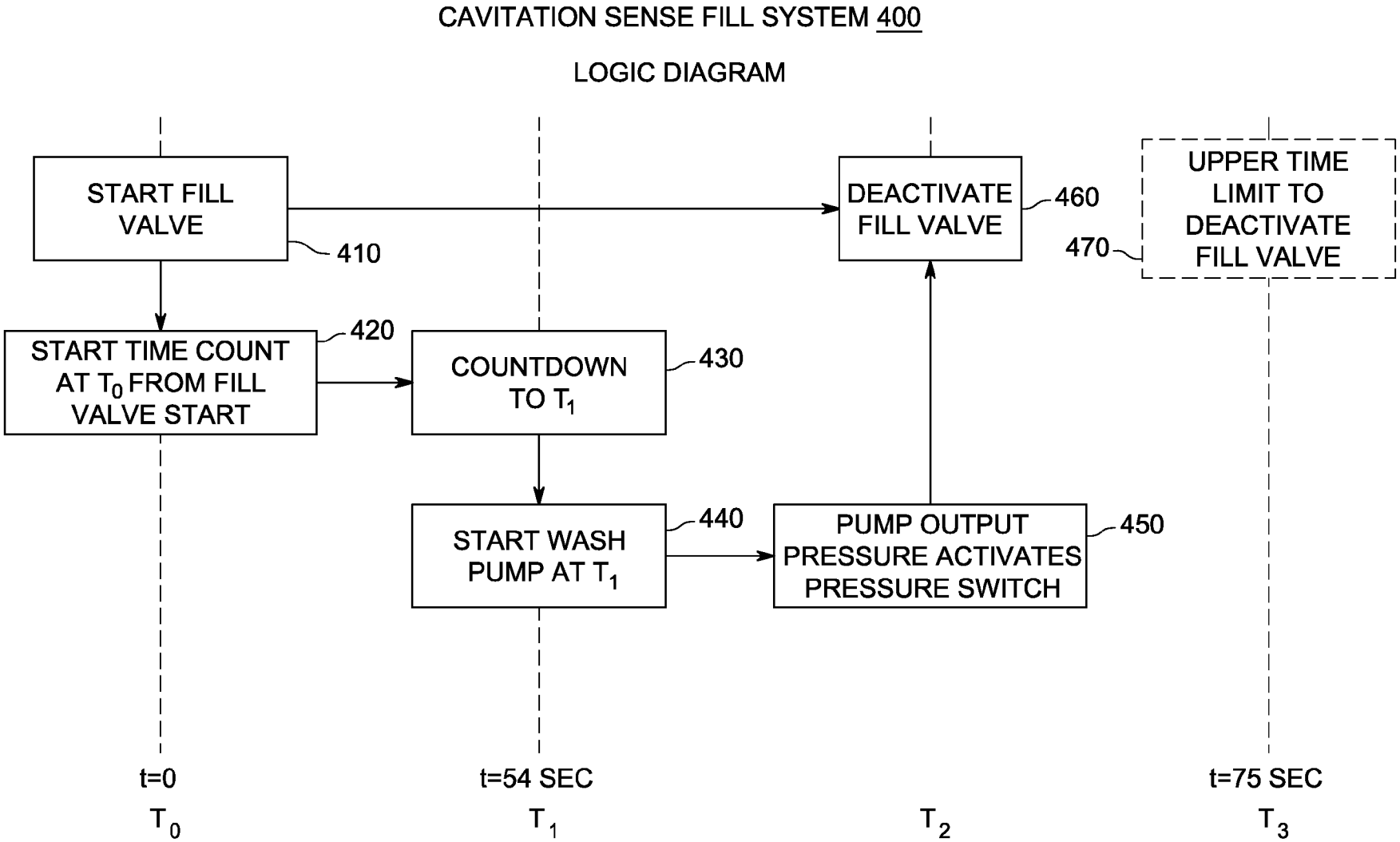
FIG. 4 is a functional block diagram of an exemplary cavitation sense fill system incorporating features of the present invention.

FIG. 4 illustrates an exemplary cavitation sense fill system 400 incorporating features of the present invention. As previously indicated, the cavitation sense fill system 400 may be embodied, for example, as an electro-mechanical pressure switch or an electronic pressure sensor. As shown in FIG. 4, the exemplary cavitation sense fill system 400 is configured to activate the fill valve 340 during step 410 and also to start a time count during step 420 at a time $T_0$. Upon detecting that the counter has reached a predefined a time $T_1$, during step 430, the exemplary cavitation sense fill system 400 starts the recirculation pump 315 (also referred to as a wash pump) during step 440. Time $T_1$, for example, 54 seconds, is provided to allow time for the fill to reach a level less than the desired fill, but sufficient to permit the pump to operate without damage to the impeller.

In addition, as discussed further below in conjunction with FIG. 5, when the exemplary cavitation sense fill system 400 detects that the output pressure of the recirculation pump 315 reaches a predefined threshold value, as detected during step 450, at a variable time $T_2$, the exemplary cavitation sense fill system 400 deactivates the fill valve 340 during step 460. In one exemplary implementation, the cavitation sense fill system 400 also includes an upper time limit, at a time $T_3$, detected at step 470, that will automatically deactivate the fill valve 340 regardless of the output pressure of the recirculation pump 315 (to prevent filling beyond the maximum acceptable level).

In this manner, the exemplary cavitation sense fill system 400 enables the dishwasher 100 to automatically deliver only a desired volume of water needed for proper wash pump operation.

Figure 5:
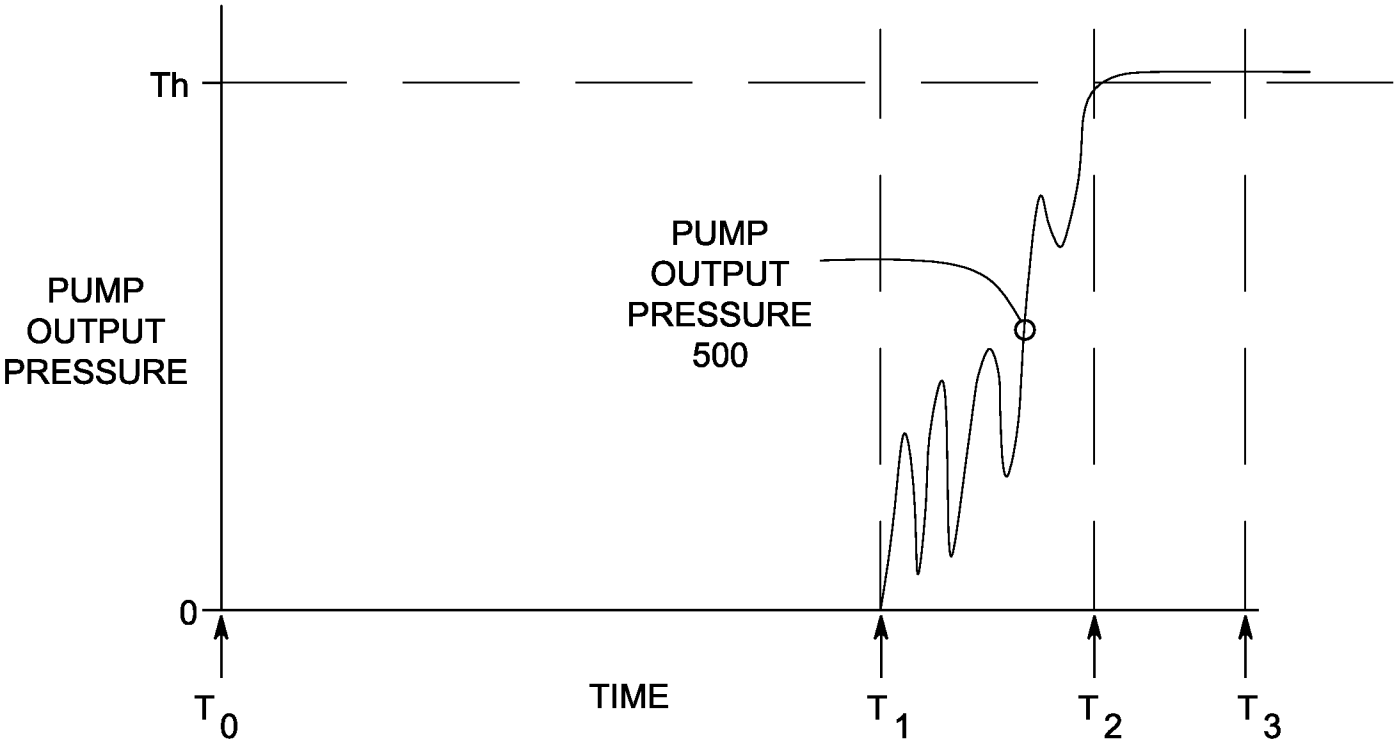
FIG. 5 illustrates the output pressure of the recirculation pump of FIG. 3 as a function of time.

FIG. 5 illustrates the output pressure 500 of the recirculation pump 315 of FIG. 3 as a function of time. As shown in FIG. 5, and as discussed above in conjunction with FIG. 4, the exemplary cavitation sense fill system 400 activates the fill valve 340 at a time $T_o$. Generally, as shown in FIG. 5, the measured output pressure would expected to be substantially 0 until the recirculation pump 315 is turned on at time $T_1$. After the recirculation pump 315 is turned on at time $T_1$, ripples are evident in the pump output pressure 500 due to surges from the pump cavitation (i.e., insufficient water).

In addition, when the exemplary cavitation sense fill system 400 detects that the output pressure 500 of the recirculation pump 315 reaches a predefined threshold value, Th, for example, 5 psi, as detected at a time $T_2$, the exemplary cavitation sense fill system 400 deactivates the fill valve 340. In one exemplary implementation, a pressure switch can be activated by the water pressure at the output of the recirculation pump 315 reaching and maintaining the threshold pressure value, Th, for example, for a minimum predefined time interval, such as 1-2 seconds to assure responding to a relatively stable pressure condition. In one exemplary implementation, the cavitation sense fill system 400 also includes an upper time limit, at a time $T_3$, such as 75 seconds, that if exceeded, will result in automatically deactivating the fill valve 340 regardless of the output pressure of the recirculation pump 315. Generally, the time $T_3$, is a time-out value for controlling the fill valve 340 (e.g., a worst-case upper time limit) to prevent filling beyond the maximum acceptable level.

Figure 6:
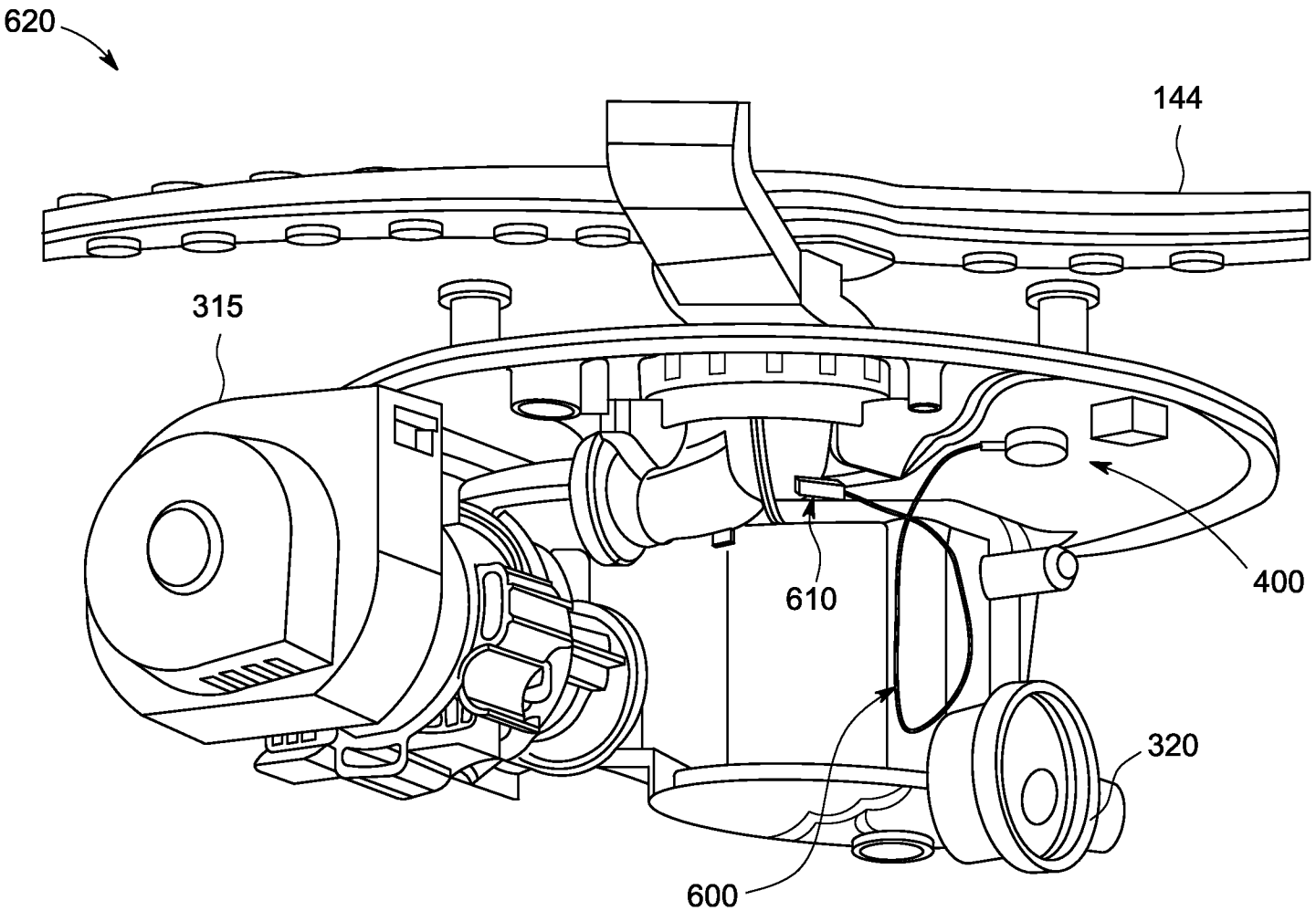
FIG. 6 is a bottom perspective view of a fluid distribution assembly of the dishwasher system of FIG. 1 illustrating a pressure wave damper incorporating a further aspect of the invention.

FIG. 6 is a bottom perspective view of a fluid distribution assembly 620 and lower spray arm assembly 144 of the dishwasher system 100 of FIG. 1. FIG. 6 illustrates the relationship between the recirculation pump 315, drain pump 320 and the exemplary cavitation sense fill system 400, such as a pressure switch. Generally, the recirculation pump 315 recirculates water and dishwasher fluid in dishwasher tub 104; and the drain pump 320 draws wash fluid from the sump 142 and out through a drain (not shown), to withdraw water from the wash chamber 106.

As previously indicated, the cavitation sense fill system 400 monitors the output pressure of the recirculation pump 315 and determines when an appropriate water fill level has been reached. According to a further aspect of the invention, a pressure wave damper may be employed to ensure that the cavitation sense fill system 400 is monitoring stable pressure measurements and thereby avoid a false trigger of the cavitation sense fill system 400. In this manner, the cavitation sense fill system 400 processes an overall average pressure over time.

For example, as shown in FIG. 6, the pressure wave damper may be implemented as tubing 600 having a loop, and connected at one end by a nipple 610 to the output of the recirculation pump 315. The other end of the tubing 600 is connected to the cavitation sense fill system 400. The tubing 600 may optionally be filled with water and/or air to absorb the pressure ripples and prevent a false trigger of the cavitation sense fill system 400.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been illustrated and/or described with respect to only one of several implementations, such feature may be combined with one or more other features of the other implementations as may be desired and advantageous for any given or particular application. Furthermore, references to singular components or items are intended, unless otherwise specified, to encompass two or more such components or items. Also, to the extent that the terms "including", "includes", "having" "has", "with", or variants thereof are used in the detailed description and/or in the claims, such terms are intended to be inclusive in a manner similar to the term "comprising". The invention has been described with reference to the preferred embodiments. Obviously, modifications and alterations will occur to others upon reading and understanding the preceding detailed description. It is intended that the invention be construed as including all such modifications and alterations.

Thus, while there has been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A dishwasher system comprising:

a tub;

a fluid circulation system for circulating water in the tub, wherein the fluid circulation system comprises at least one recirculation pump and at least one fill valve;

a cavitation sense fill system; and tubing connected at a first end to an output of the at least one recirculation pump and at a second end to the cavitation sense fill system, the tubing having at least one loop therein forming a pressure wave damper;

wherein the cavitation sense fill system is configured to:

monitor an average output pressure of the at least one recirculation pump using the pressure wave damper; and deactivate the at least one fill valve when the average output pressure satisfies at least one predefined criterion.

2. The dishwasher system of claim 1, wherein the at least one predefined criterion comprises a minimum threshold pressure.

3. The dishwasher system of claim 1, wherein the at least one predefined criterion comprises a minimum threshold pressure being maintained for a minimum time interval.

4. The dishwasher system of claim 1, further comprising means for detecting a time-out condition for the at least one fill valve.

5. The dishwasher system of claim 1, wherein the at least one fill valve is activated at a first predefined time and the at least one recirculation pump is activated at a second predefined time.

6. The dishwasher system of claim 1, wherein the tubing forming the pressure wave damper is filled with water and air.

7. The dishwasher system of claim 1, wherein the tubing forming the pressure wave damper is filled with water.

8. The dishwasher system of claim 1, wherein the tubing forming the pressure wave damper is filled with air.

* * * * *